US006378655B1

(12) United States Patent
Campbell

(10) Patent No.: US 6,378,655 B1
(45) Date of Patent: Apr. 30, 2002

(54) STAIR-STEPPER LADDER LEG

(76) Inventor: Trey Scott Campbell, 102 El Lobo La., Bailey, CO (US) 80421

( * ) Notice: Subject to any disclaimer, the term of this patent is extended or adjusted under 35 U.S.C. 154(b) by 0 days.

(21) Appl. No.: 09/481,160

(22) Filed: Jan. 12, 2000

(51) Int. Cl.[7] ..... E06C 1/00; E06C 7/00
(52) U.S. Cl. ..... 182/169; 182/162; 182/204
(58) Field of Search ..... 182/225, 226, 182/153, 169, 204, 201, 208, 166, 167, 170, 173, 174, 172

(56) References Cited

U.S. PATENT DOCUMENTS

| | | | | | |
|---|---|---|---|---|---|
| 4,249,637 | A | * | 2/1981 | Glasgow | 182/170 |
| 4,412,599 | A | | 11/1983 | McCrudden | 182/201 |
| 4,524,849 | A | * | 6/1985 | Riddle | 182/170 |
| 4,600,080 | A | * | 7/1986 | Forrester | 182/169 X |
| 4,606,432 | A | | 8/1986 | Belt | 182/204 |
| 4,646,876 | A | * | 3/1987 | Grawi | 182/167 X |
| 4,719,990 | A | | 1/1988 | Markovic | 182/163 |
| 4,798,262 | A | * | 1/1989 | Margolies | 182/169 X |
| 5,009,283 | A | * | 4/1991 | Prejean | 182/116 |
| 5,526,898 | A | | 6/1996 | Clark | 182/200 |
| 5,590,739 | A | * | 1/1997 | High et al. | 182/169 |

FOREIGN PATENT DOCUMENTS

| | | | | |
|---|---|---|---|---|
| JP | 11081843 | * | 3/1999 | 182/169 X |

* cited by examiner

*Primary Examiner*—Daniel P. Stodola
*Assistant Examiner*—Hugh B. Thompson

(57) ABSTRACT

An accessory replacement front ladder leg assembly for use with the standard tripod stepladder consisting of an outer sleeve member having incremental penetrations disposed therein an inner sleeve member also having incremental penetrations that slides in and out of the outer sleeve member. The outer sleeve and inner sleeve members are locked together by a hitchpin when the incremental penetrations are aligned. The replacement leg is then adapted to the user's own tripod stepladder after removal of the tripod's front leg.

1 Claim, 2 Drawing Sheets

STAIR-STEPPER LADDER LEG

BACKGROUND

1. Field of Invention

The invention relates to an accessory retractable front leg for a tripod stepladder, in particular, a replacement leg which allows the tripod stepladder to be used in a conventional manner wherein the front and rear legs are located on the same surface or in an unconventional manner wherein the front leg is located on a raised surface above a second surface whereupon the rear legs are supported.

2. Description of Prior Art

The invention has special relevance for use on stairs. Often electricians, painters and drywallers must do work above staircases. The tripod stepladder, as designed, is used only on flat surfaces.

Stepladders with telescopic front legs are available. U.S. Pat. No. 359,716 (Diltx), U.S. Pat. No. 1,312,725 (Gagnier), U.S. Pat. No. 2,200,535 (Brewer), U.S. Pat. No. 4,412,599 (McCrudden), U.S. Pat. No. 4,719,990 (Markovic) and U.S. Pat. No. 5,526,898 (Clark) all relate to ladders which use telescopic legs and are for use on stairs. These devices, however, do not adapt to the standard tripod stepladder. Furthermore, these devices are made to extend the ladder legs rather than retract the ladder legs. Also, the present invention eliminates the need for timely modifications to the ladder before its use. The present invention can be permanently attached to the standard tripod stepladder in a minimal amount of time.

SUMMARY INCLUDING OBJECTS AND ADVANTAGES

In accordance with the present invention, it is an object of the present invention to provide a retractable ladder leg which may be adapted to the user's standard tripod stepladder in order to provide means for stabilizing the ladder on stairs.

Objects and Advantages

Accordingly, several objects and advantages of the invention are to provide means for using the tripod stepladder on stairs. The "Stair-Stepper Ladder Leg" provides a one time modification for use and a fast, easy set up. Still further objects and advantages will become apparent from a consideration of the ensuing description and accompanying drawings.

It is an object of the present invention to provide an accesory replacement leg which may be permanently installed on standard tripod stepladders in order to provide means for retracting the length of the front of the user's ladder.

It is a further object of the present invention to provide an accessory leg which may be permanently attached using the existing hardware from the standard tripod stepladder.

It is an additional object of the present invention to provide a hitchpin whereby the leg can be retracted to varying lengths and locked into place.

These and other objects of the invention, as described herein, are achieved by providing an actual ladder leg comprised of an outer sleeve member having incremental penetrations and an inner sleeve member having incremental penetrations which fits inside said outer sleeve member and telescopically moves in and out of said outer sleeve member and locks into place with a hitchpin when incremental penetrations are aligned. The ladder leg assembly may be permanently attached to the user's tripod stepladder after removal of the original front leg using the ladders existing hardware (i.e. internal spreaders, upper brace, u bolt attachment and, through bolt, etc . . . ).

Figure 1:
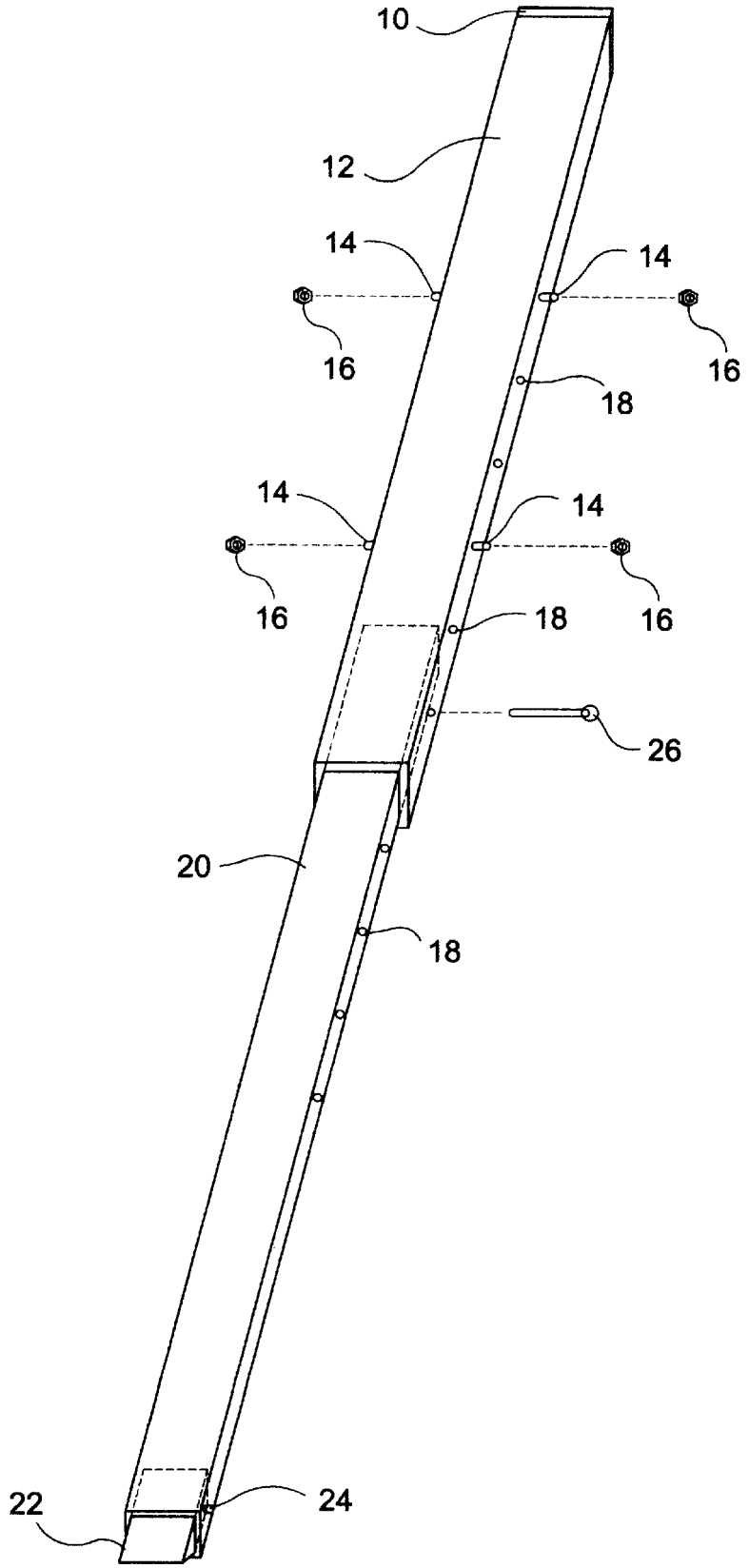
FIG. 1 is a perspective view of the invention.

REFERENCE NUMERALS square PVC dust cap
12 aluminum square tubular outer sleeve
14 threaded zinc rods
16 nylon locking nuts
18 incremental penetrations
20 square fiberglass inner sleeve
22 angle cut wood insert
24 wood screw
26 hitchpin
28 u bolt attachments
30 upper brace
32 internal spreaders

Proffered Embodiment—Description

Figure 2:
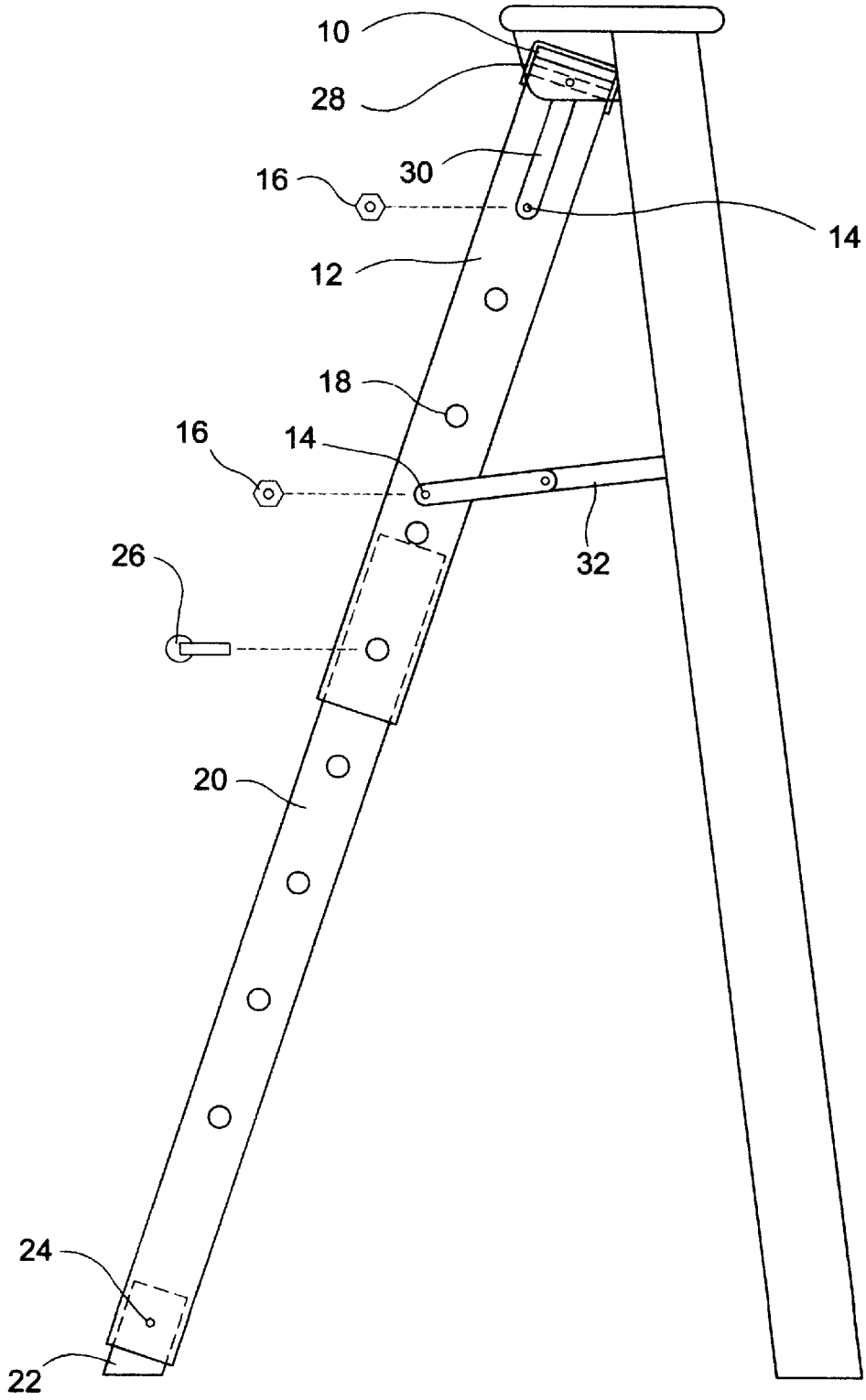
FIG. 2 shows how the Stair-Stepper Ladder Leg adapts to the user's tripod stepladder.

A preffered embodiment of the the present invention is illustrated in FIG. 1 and FIG. 2. In FIG. 1 the ladder leg has a square PVC dust cap 10 which fits onto an aluminum square tubular outer sleeve 12. Outer sleeve 12 has two sets of threaded zinc rods 14 and nylon locking nuts 16. In an aluminum square tubular outer sleeve 12 are incremental penetrations 18. A square fiberglass inner sleeve 20 also has incremental penetrations 18. At the bottom of a square fiberglass inner sleeve 20 is an angle cut wood insert 22 attached with a wood screw 24. A ball bearing type hitchpin 26 fits inside incremental penetrations 18. In FIG. 2 the u bolt attachments 28 from the user's tripod stepladder fit onto an aluminum square tubular outer sleeve 12. The upper brace 30 from the user's tripod stepladder attaches to threaded zinc rods 14 on both sides of an aluminum square tubular outer sleeve 12. The internal spreaders 32 from the user's tripod stepladder adapts to threaded zinc rods 14a on both sides of aluminum square tubular outer sleeve 12.

Preferred Embodiment—Operation

In FIG. 1 a square PVC dust cap 10, covers the opening at the top of an aluminum square tubular outer sleeve 12. A square fiberglass inner sleeve 20 fits inside of an aluminum square tubular outer sleeve 12 and telescopically moves in and out of an aluminum square tubular outer sleeve 12 to change the length of the front of the tripod stepladder. When incremental penetrations 18 of both an aluminum square tubular outer sleeve 12 and a square fiberglass inner sleeve 20 are aligned, a hitchpin 26 is then inserted through both an aluminum square tubular outer sleeve 12 and a square fiberglass inner sleeve 20 to hold in place. An angle cut wood insert 22 provides a foot for the ladder leg that is attached with a wood screw 24. As shown in FIG. 2, after removal of the original front leg of the existing tripod stepladder, the ladder leg is attached using threaded zinc rods 14, u bolt attachments 28, upper brace 30, and internal spreaders 32. Threaded zinc rods 14 is ridgedly attached to an aluminum square tubular outer sleeve 12 on both sides and provides attachment to an upper brace 30 of the existing tripod stepladder with use of nylon locking nuts 16. Threaded zinc rods 14 is ridgedly attached to an aluminum square tubular outer sleeve 12 on both sides to attach to internal spreaders 32 of the user's tripod stepladder with use of nylon locking nuts 16. U bolt attachments 28 of the user's tripod stepladder secures the top of the ladder leg.

Conclusions, Ramifications, and Scope

Accordingly, it can be seen that the average construction worker, electrician, builder or homeowner will see that the Stair-Stepper Ladder Leg provides a different way to use the standard tripod stepladder with a one time modification for use and a fast, easy way to set up. It allows for the existing hardware of the user's tripod stepladder to be adapted to the Stair-Stepper Ladder Leg.

Although the description above contains many specificities, these should not be construed as limiting the scope of the invention but as merely providing illustrations of some of the presently preferred embodiments of this invention. Various other embodiments and ramifications are possible within it's scope. For example, the Stair-Stepper Ladder Leg can be made for any size tripod stepladder. Thus the scope of the invention should be determined by the appended claims and their legal equivalents, rather than by the examples given.

What is claimed is:

1. An accessory replacement front ladder leg that is adaptable to a user's standard tripod stepladder, which provides a means for use on stairs, the ladder leg consisting of:

(a) a tubular outer sleeve member having incremental penetrations, (b) a tubular inner sleeve member having incremental penetrations, the inner sleeve member being receivable within the outer sleeve member, (c) a hitchpin which locks the inner and outer sleeve members together when said incremental penetrations of respective sleeve members are aligned, (d) a shoe mounted on a lower portion of the inner sleeve member, for contact with a flat contact surface, (e) two pairs of threaded studs securely mounted to opposed outer sides of upper and lower portions of the outer sleeve member, which allow for securement of the ladder leg to an uppermost and middle portion of the stepladder, while permitting the inner sleeve member to completely retract into the outer sleeve member.

* * * * *